US010794227B1

(12) United States Patent
Freeman

(10) Patent No.: US 10,794,227 B1
(45) Date of Patent: Oct. 6, 2020

(54) SYSTEM AND METHOD FOR HARNESSING LATENT HEAT TO GENERATE ENERGY

(71) Applicant: Walter B. Freeman, Cave Junction, OR (US)

(72) Inventor: Walter B. Freeman, Cave Junction, OR (US)

( * ) Notice: Subject to any disclaimer, the term of this patent is extended or adjusted under 35 U.S.C. 154(b) by 3 days.

(21) Appl. No.: 16/351,397

(22) Filed: Mar. 12, 2019

Related U.S. Application Data

(60) Provisional application No. 62/721,089, filed on Aug. 22, 2018.

(51) Int. Cl.

| | |
|---|---|
| ***F01K 13/00*** | (2006.01) |
| ***F01K 3/00*** | (2006.01) |
| ***F01D 15/12*** | (2006.01) |
| ***F01D 15/10*** | (2006.01) |
| ***F01D 15/08*** | (2006.01) |
| ***F01K 11/00*** | (2006.01) |

(52) U.S. Cl.
CPC ..... *F01K 13/00* (2013.01); *F01D 15/08* (2013.01); *F01D 15/10* (2013.01); *F01D 15/12* (2013.01); *F01K 3/006* (2013.01); *F01K 11/00* (2013.01)

(58) Field of Classification Search
CPC ..... F01K 25/08; F25B 11/00; F25B 13/00; F25B 27/00
See application file for complete search history.

(56) References Cited

U.S. PATENT DOCUMENTS

| | | | | |
|---|---|---|---|---|
| 3,995,428 | A | 12/1976 | Roberts | |
| 4,231,842 | A | 11/1980 | Ojala | |
| 4,527,398 | A | 7/1985 | Schaetzle | |
| 6,926,979 | B2 | 8/2005 | Cao | |
| 7,685,821 | B2 | 3/2010 | Kalina | |
| 8,459,039 | B2 * | 6/2013 | Allam | F01K 23/10 60/785 |
| 8,991,181 | B2 * | 3/2015 | Palmer | F01K 25/06 60/641.2 |
| 9,931,593 | B2 * | 4/2018 | Amte | B01D 53/12 |
| 2004/0103637 | A1 * | 6/2004 | Maisotsenko | F01K 21/047 60/39.59 |
| 2007/0033942 | A1 * | 2/2007 | Benz | F02C 3/205 60/772 |
| 2013/0192193 | A1 * | 8/2013 | Yoshida | F22B 1/006 60/39.182 |
| 2014/0060050 | A1 * | 3/2014 | Kosamana | F03G 6/067 60/651 |
| 2015/0007500 | A1 * | 1/2015 | Schatz | E05F 15/668 49/70 |
| 2016/0177821 | A1 * | 6/2016 | Allam | F02C 7/141 60/783 |
| 2017/0355617 | A1 | 12/2017 | Wang | |
| 2018/0099244 | A1 | 4/2018 | Okano | |

* cited by examiner

*Primary Examiner* — Shafiq Mian
(74) *Attorney, Agent, or Firm* — Jerry Haynes Law

(57) ABSTRACT

A system and method for harnessing latent heat to generate energy. The system and method provide a fully closed latent heat recovery system that utilizes a vapor source to generate vapor. A plurality of conduits carries the vapor and resultant gas, expanded energy, and condensate to: a vapor expander, a compressor, a heat exchanger, an accumulator, and a vapor condenser for expansion, compression, and conversion between states of the vapor. The latent heat generated from the expansion and energy release from the vapors and gases produces work for driving a load.

13 Claims, 3 Drawing Sheets

SYSTEM AND METHOD FOR HARNESSING LATENT HEAT TO GENERATE ENERGY

CROSS-REFERENCE TO RELATED APPLICATIONS

This application claims the benefits of U.S. provisional application No. 62/721,089, filed Aug. 22, 2018 and entitled ENHANCED THERMAL ENERGY RECOVERY SYSTEM, which provisional application is incorporated by reference herein in its entirety.

FIELD OF THE INVENTION

The present invention relates generally to a system and method for harnessing latent heat to generate energy. More so, the present invention relates to a fully closed latent heat recovery system that utilizes a vapor source to generate vapor. A plurality of conduits carries the vapor and resultant gas, expanded energy, and condensate to: a vapor expander, a compressor, a heat exchanger, an accumulator, and a vapor condenser for expansion, compression, and conversion between states of the vapor. The latent heat generated from the expansion and energy release from the vapors and gases produces work for driving a load.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, latent heat is thermal energy that is released or absorbed, by a body or a thermodynamic system, during a constant-temperature process. Latent heat is also known as heat energy that is in hidden form which is supplied or extracted to change the state of a substance without changing its temperature. Generally, when a material in liquid state is given energy, it changes its phase from liquid to vapor. The energy absorbed in this process is called heat of vaporization, which is the opposite process of condensation.

Generally, steam power efficiency has historically been limited by the loss of latent heat of vaporization, which amounts to 966 BTU per pound of water converted into vapor. It is known that the molecules in liquid water are held together by relatively strong hydrogen bonds, and their enthalpy of vaporization, 40.65 kJ/mole, is more than five times the energy required to heat the same quantity of water from 0° C. to 100° C. Thus, the loss of heat from water when high temperatures and pressures are applied, is significant. The present invention reduces that loss by utilizing a significant portion of the latent heat of vaporization to produce power.

Other proposals have involved collecting and recycling latent heat in a system. The problem with these energy recovery systems is that they do not provide multiple, different points of collecting the latent heat. Even though the above cited energy recovery systems meet some of the needs of the market, a fully closed latent heat recovery system and method that utilizes a vapor source to generate vapor. A plurality of conduits carries the vapor and resultant gas, expanded energy, and condensate to: a vapor expander, a compressor, a heat exchanger, an accumulator, and a vapor condenser for expansion, compression, and conversion between states of the vapor. The latent heat generated from the expansion and energy release from the vapors and gases produces work for driving a load, is still desired.

SUMMARY

Illustrative embodiments of the disclosure are generally directed to a system and method for harnessing latent heat to generate energy. The system and method provide a fully closed latent heat recovery system that utilizes a vapor source to generate vapor. A plurality of conduits carries the vapor and resultant gas, expanded energy, and condensate to: a vapor expander, a compressor, a heat exchanger, an accumulator, and a vapor condenser for expansion, compression, and conversion between states of the vapor. This produces work for driving a load.

The system provides a vapor source that generates vapor, or steam. The vapor source may include, without limitation, a boiler, a heat exchanger, a source of stored heated liquid, a solar thermal collector, or a geothermal source of steam or hot water. The vapor is carried through a vapor source conduit to a vapor expander. The vapor expander recovers the expansion work of the vapor, generating energy and excess exhaust.

The vapor expander is operatively connected to a primary load. The primary load may include, without limitation, an electrical generation system, a pump, and a direct-connected mechanical device. The generated energy from the vapor expander urges articulation of mechanical components in the primary load, which in turn, generates electricity. In addition to energy, the vapor expander also emits exhaust. The exhaust from the vapor expander flows through a vapor expander exhaust conduit to a vapor condenser, or a cooled gas re-heater. The vapor condenser causes the exhaust to form a condensate.

Additionally, the energy generated by the vapor expander is harnessed to power a compressor. The compressor is configured to compress a gas, i.e., air. The compression of the gas, raises the temperature of the gas by a factor directly proportional to the compression ratio of the compressor. This results in a controlled generation of a compressed and heated gas.

The compressed and heated gas travels through a hot gas transfer conduit to a heat exchanger. While passing through the length of the heat exchanger, the compressed and heated gas releases heat and consequently cools to a cooled gas. The released heat works to heat the condensate from the vapor condenser. Consequently, the condensate is heated and returned to the vapor source through a heated condensate return conduit.

A portion of the cooled gas that has passed through the heat exchanger is carried to a receiver accumulator through a cooled gas transfer conduit. The gas is then stored and may be used for multiple functions, including for use in the compressor.

Another portion of the cooled gas is carried to the vapor condenser through the cooled gas transfer conduit. Heat is consequently transferred from the exhaust of the vapor expander to the cooled gas in the vapor condenser. The re-heated gas is then transferred through a conduit, to a gas expander to produce work that drives a gas expander load. In some embodiments, the gas expander may include, without limitation, a motor, a turbine, and a device similar in design to that of the thermal energy recovery previously referenced.

The generated work from the gas expander urges articulation of mechanical components in a gas expander load, which in turn, generates electricity. A gas expander exhaust conduit carries at least a portion of the re-heated gas from the gas expander to the compressor for further compression and heating of the gas.

One objective of the present invention is to provide an advantageous method for recovering the heat of generated vapor without experiencing the disadvantages met with the existing techniques.

Another objective is to provide a closed loop latent heat recovery system that efficiently recovers the latent heat released from the vapor during condensation, expansion, and energy release by the steam.

Yet another objective is to convert recovered latent heat to produce work for driving a load.

Yet another objective is to efficiently carry the vapor, condensate, and the compressed and heated gas through a series of strategically placed conduits for heating and cooling through a vapor condenser, a gas expander, a vapor expander, a compressor, and a heat exchanger to change the state of water, such that latent energy is recovered and harnessed to drive a load.

Yet another objective is to create an efficient latent heat recovery system and method, operable for various manufacturing, utility, and agricultural uses.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 1:
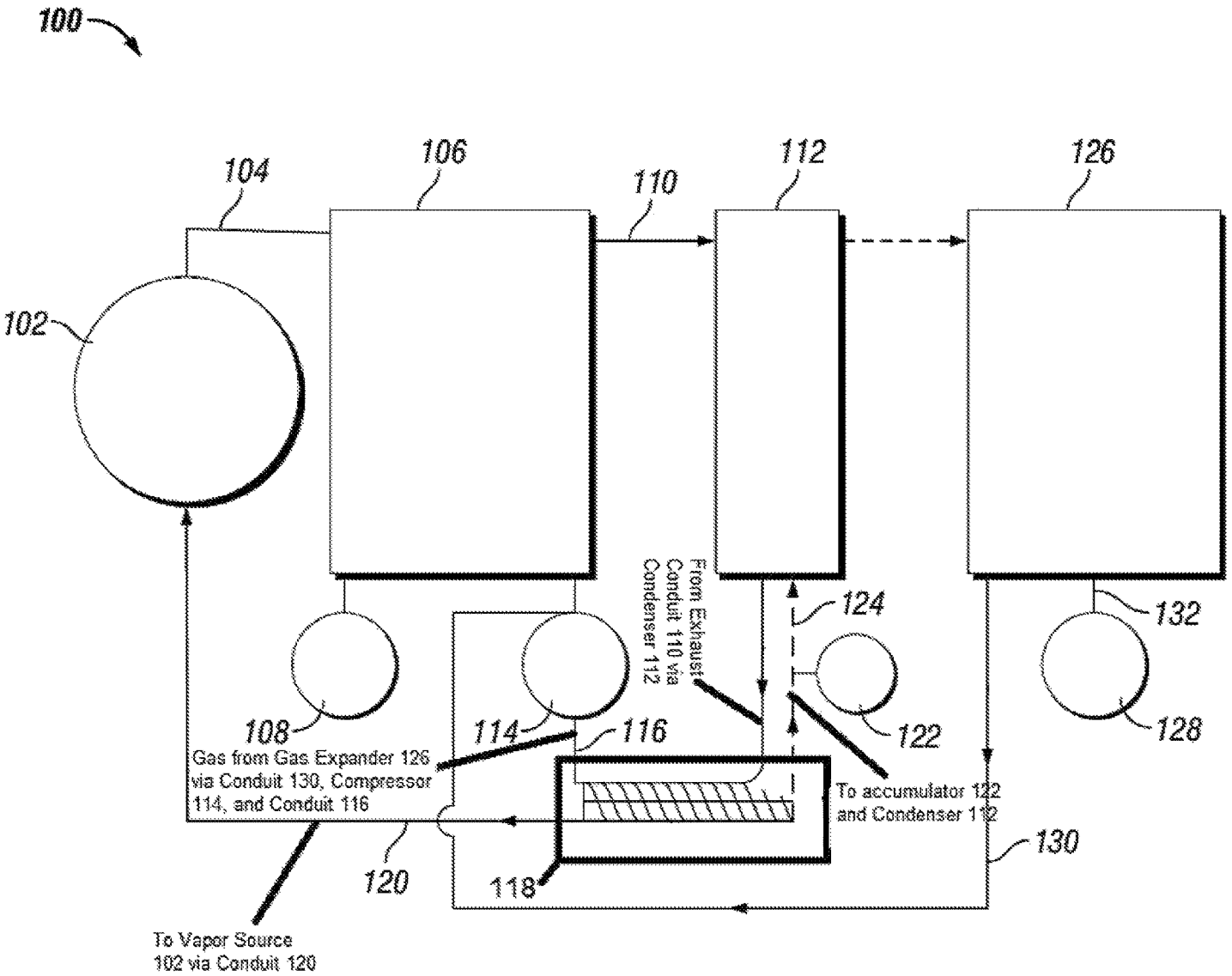
FIG. 1 illustrates a block diagram of an exemplary a method for harnessing latent heat to generate energy, in accordance with an embodiment of the present invention.
Figure 2A:
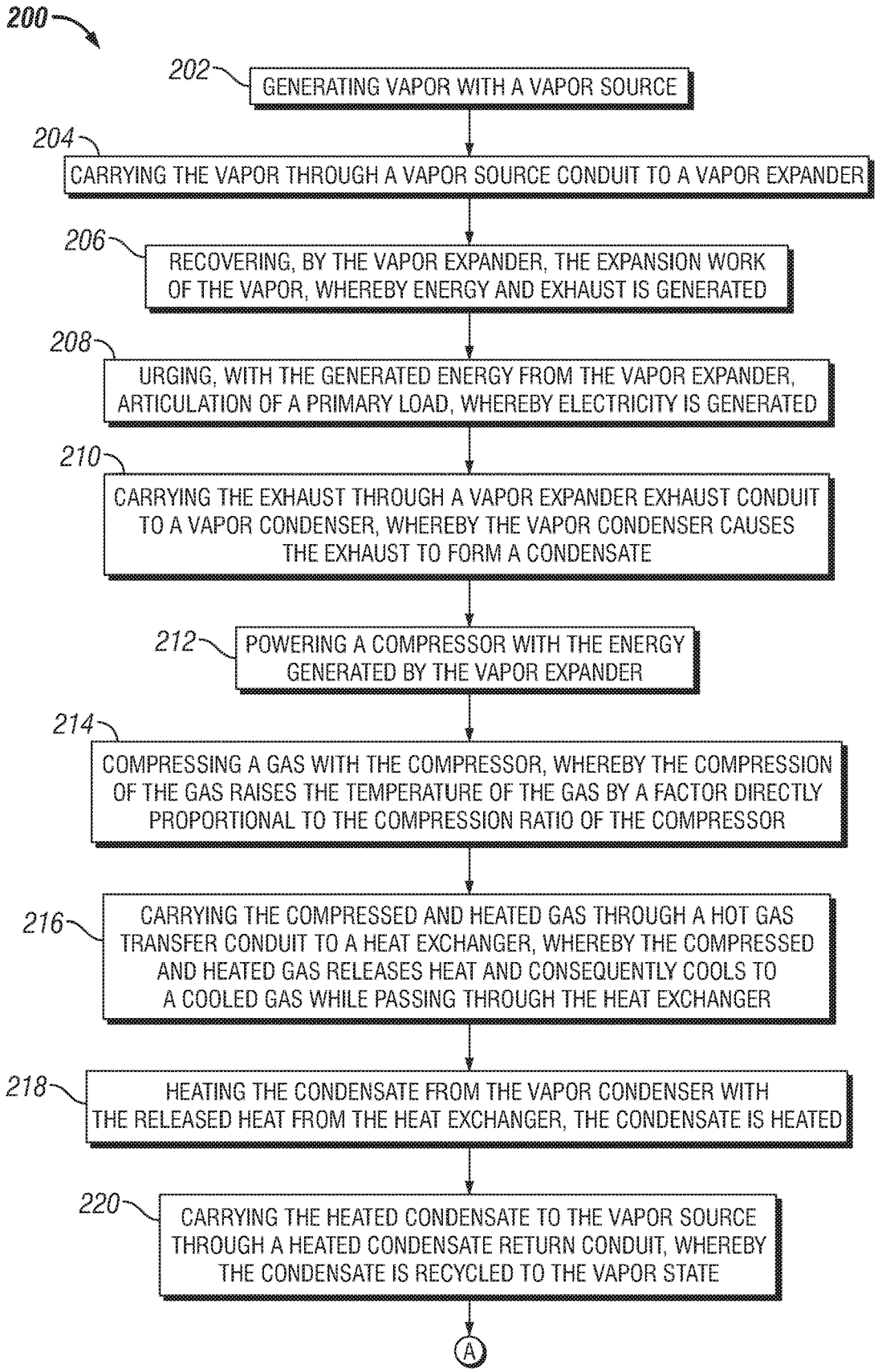
FIGS. 2A and 2B illustrate flowcharts for a method for harnessing latent heat to generate energy, in accordance with an embodiment of the present invention.
Figure 2B:
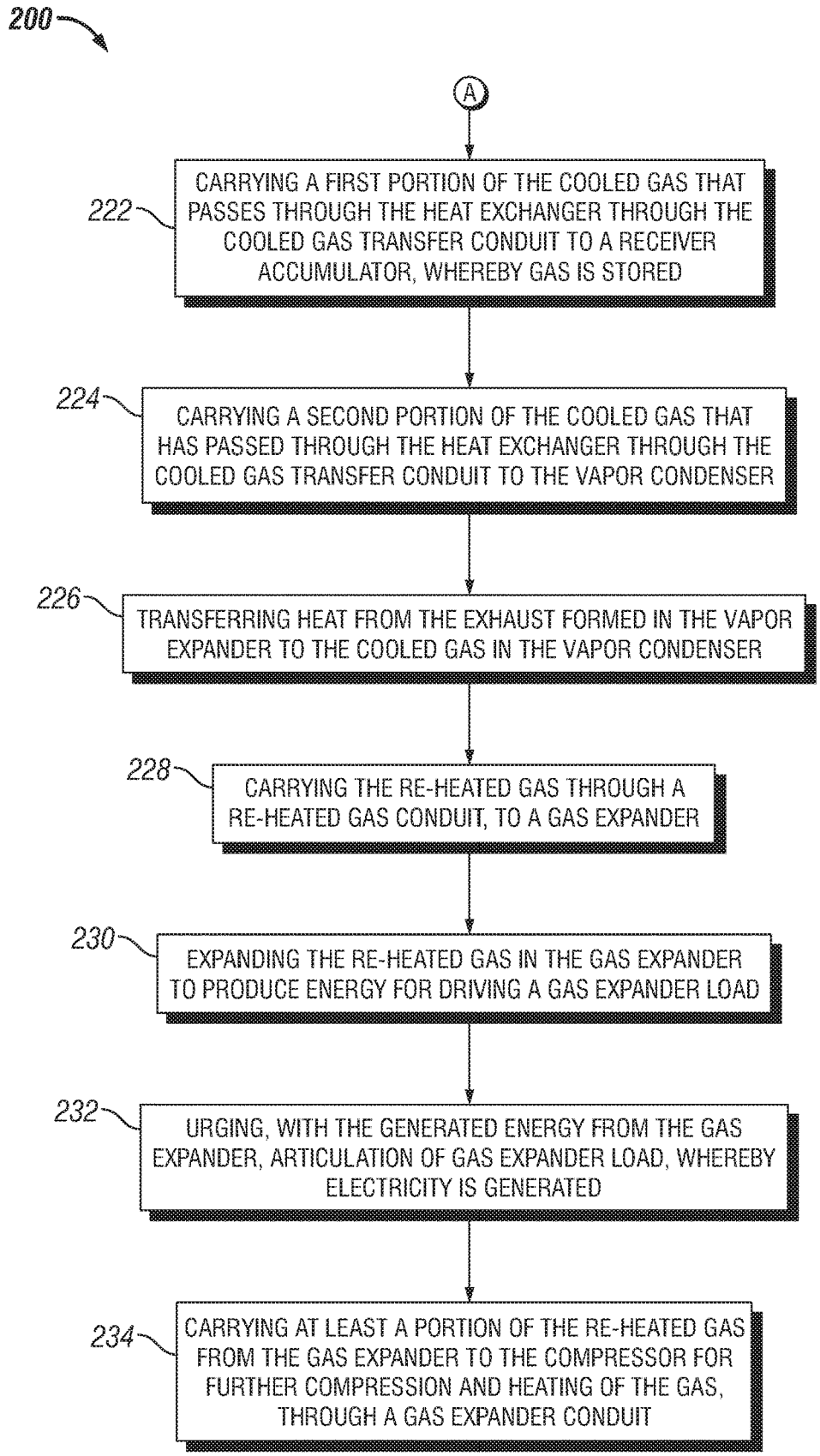

A closed loop latent heat recovery system 100 and method 200 of harnessing latent heat is referenced in FIGS. 1-2B. The system 100 for harnessing latent heat, hereafter "system 100", provides a fully closed latent heat recovery system 100 that utilizes a vapor source to generate vapor. A plurality of conduits carries the vapor and resultant gas, expanded energy, and condensate to: a vapor expander, a compressor, a heat exchanger, an accumulator, and a vapor condenser for expansion, compression, and conversion between states of the vapor. The latent heat generated from the expansion and energy release from the vapors and gases produces work for driving a load.

Those skilled in the art will recognize that latent heat refers to the energy required to transform water into steam, also known as the Enthalpy or Heat of Vaporization. By absorbing this Latent Heat, water becomes steam, and by releasing it, steam reverts to high temperature water (condensate). The present invention heats, cools, and compresses the vapor and its varying forms to produce work for driving a load.

Thus, an objective of the present invention is to provide a closed loop latent heat recovery system 100 to recover the latent heat released from the vapor during condensation, expansion, and energy release by the steam. The recovered heat can be converted to work to drive a load. In other embodiments, the recovered latent heat is, however, also operable to heat water, and the hot water can be supplied to the boiler (or a heat exchanger, or a source of stored heated liquid), industry processes, businesses, animal husbandry industry, houses, and entertainment businesses that require hot water. This is advantageous as an important energy saving function, reducing costs, and increasing economic effect.

As FIG. 1 references, the system 100 provides a vapor source 102 that generates vapor, or steam. The vapor source may include, without limitation, a boiler, a heat exchanger, a source of stored heated liquid, a solar thermal collector, or a geothermal source of steam or hot water. The vapor is carried through a vapor source conduit 104 to a vapor expander 106. The vapor expander 106 recovers the expansion work of the vapor, generating energy and excess exhaust. In some embodiments, the vapor expander may include, without limitation, a turbine, a motor, a steam engine, or a thermal energy recovery system 100 as described in U.S. Pat. No. 9,835,145.

The vapor expander 106 is operatively connected to a primary load 108. The primary load may include, without limitation, an electrical generation system, a pump, and a direct-connected mechanical device. The generated energy from the vapor expander 106 urges articulation of mechanical components in the primary load, which in turn, generates electricity. In addition to energy, the vapor expander 106 also emits exhaust.

The exhaust from the vapor expander 106 flows through a vapor expander exhaust conduit 110 to a vapor condenser 112, or a cooled gas re-heater. In some embodiments, the vapor expander exhaust conduit 110, and other conduits in the system 100, may include a tubular section or hollow cylinder. The conduits may have a material composition of Inconel, chrome moly, and titanium steel alloys used in high temperature and pressure piping in process and power facilities.

The vapor condenser 112 causes the exhaust to form a condensate. Those skilled in the art will recognize that condensate is the liquid formed when steam passes from the vapor to the liquid state. In a heating process, condensate is the result of steam transferring a portion of its heat energy, known as latent heat, to the product, line, or equipment being heated.

Additionally, the energy generated by the vapor expander 106 is harnessed to power a compressor 114. The compressor 114 is configured to compress a gas, i.e., air. The compression of the gas, raises the temperature of the gas by a factor directly proportional to the compression ratio of the compressor 114. This results in a controlled generation of a compressed and heated gas, as the compression ratio of the compressor 114 can be adjusted to change the temperature of the gas.

After passing through the compressor 114, the compressed and heated gas travels through a hot gas transfer conduit 116 to a heat exchanger 118. While passing through the length of the heat exchanger 118, the compressed and heated gas releases heat and consequently cools to a cooled gas. The released heat works to heat the condensate from the vapor condenser 112. Consequently, the condensate is heated and returned to the vapor source 102 through a heated condensate return conduit 120. The condensate is then recycled to the vapor state in the vapor source.

In one optional configuration, the condensate is returned to a point ahead of the vapor source (solar thermal collector); just before the vapor expander 106, or to a hot liquid storage system.

Looking again at FIG. 1, a first portion of the cooled gas that has passed through the heat exchanger 118 is carried to a receiver accumulator 122 through a cooled gas transfer conduit 124. The gas is then stored and may be used for multiple functions, including for use in the compressor 114. Though in other embodiments, the stored gas may be used to generate electricity, or power one of the components in the system 100.

A second portion of the cooled gas is carried to the vapor condenser 112 through the cooled gas transfer conduit 124. Heat is consequently transferred from the exhaust of the vapor expander 106 to the cooled gas in the vapor condenser 112. The re-heated gas is then transferred through a re-heated gas conduit 132, to a gas expander 126. The gas expander 126 produces work that drives a gas expander load 128. In some embodiments, the gas expander 126 may include, without limitation, a motor, a turbine, and a device similar in design to that of the thermal energy recovery previously referenced.

The generated work from the gas expander 126 urges articulations of mechanical components in a gas expander load 128, which in turn, generates electricity. A gas expander exhaust conduit 130 carries at least a portion of the re-heated gas from the gas expander to the compressor 114 for further compression and heating of the gas.

FIGS. 2A and 2B illustrate flowcharts for a method 200 for harnessing latent heat to generate energy. The method 200 provides a fully closed latent heat recovery system 100 that utilizes a vapor source to generate vapor. A plurality of conduits carries the vapor and resultant gas, expanded energy, and condensate to: a vapor expander, a compressor, a heat exchanger, an accumulator, and a vapor condenser for expansion, compression, and conversion between states of the vapor. The latent heat generated from the expansion and energy release from the vapors and gases produces work for driving a load.

The method 200 may include an initial Step 202 of generating vapor with a vapor source. The vapor source may include, without limitation, a boiler, a heat exchanger, a source of stored heated liquid, a solar thermal collector, or a geothermal source of steam or hot water. The method 200 may further comprise a Step 204 of carrying the vapor through a vapor source conduit to a vapor expander. A Step 206 includes recovering, by the vapor expander, the expansion work of the vapor, whereby energy and exhaust is generated.

In some embodiments, a Step 208 comprises urging, with the generated energy from the vapor expander, articulation of a primary load, whereby electricity is generated. A Step 210 includes carrying the exhaust through a vapor expander exhaust conduit to a vapor condenser, whereby the vapor condenser causes the exhaust to form a condensate. In some embodiments, a Step 212 may include powering a compressor with the energy generated by the vapor expander. A Step 214 comprises compressing a gas with the compressor, whereby the compression of the gas raises the temperature of the gas by a factor directly proportional to the compression ratio of the compressor.

The method 200 may further comprise a Step 216 of carrying the compressed and heated gas through a hot gas transfer conduit to a heat exchanger, whereby the compressed and heated gas releases heat and consequently cools to a cooled gas while passing through the heat exchanger. The method 200 may further comprise a Step 218 of heating the condensate from the vapor condenser with the released heat from the heat exchanger, the condensate is heated. A Step 220 includes carrying the heated condensate to the vapor source through a heated condensate return conduit, whereby the condensate is ultimately recycled to the vapor state.

In some embodiments, a Step 222 comprises carrying a first portion of the cooled gas that has passed through the heat exchanger through a cooled gas transfer conduit to a receiver accumulator, whereby the gas is stored. A Step 224 includes carrying a second portion of the cooled gas that has passed through the heat exchanger through the cooled gas transfer conduit to the vapor condenser. In some embodiments, a Step 226 may include transferring heat from the exhaust formed in the vapor expander to the cooled gas in the vapor condenser.

The method 200 may further comprise a Step 228 of carrying the re-heated gas through a re-heated gas conduit, to a gas expander. The gas expander 126 may include, without limitation, a motor, a turbine, and a device similar in design to that of the thermal energy recovery previously referenced. A Step 230 comprises expanding the re-heated gas in the gas expander to produce energy for driving a gas expander load. A Step 232 includes urging, with the generated energy from the gas expander, articulation of a gas expander load, whereby electricity is generated. A final Step 234 includes carrying at least a portion of the re-heated gas from the gas expander to the compressor for further compression and heating of the gas, through a gas expander exhaust conduit.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A method for harnessing latent heat to generate energy, the method comprising:

generating vapor with a vapor source;

carrying the vapor through a vapor source conduit to a vapor expander;

recovering, by the vapor expander, the expansion work of the vapor, whereby energy and exhaust is generated;

urging, with the generated energy from the vapor expander, articulation of a primary load, whereby electricity is generated;

carrying the exhaust through a vapor expander exhaust conduit to a vapor condenser, whereby the vapor condenser causes the exhaust to form a condensate;

powering a compressor with the energy generated by the vapor expander;

compressing a gas from a gas expander with the compressor, whereby the compression of the gas raises the temperature of the gas;

carrying the compressed and the heated gas through a hot gas transfer conduit to a heat exchanger, whereby the compressed and heated gas releases heat and consequently cools to a cooled gas while passing through the heat exchanger;

heating the condensate from the vapor condenser with the released heat from the heat exchanger, the condensate is heated;

carrying the heated condensate to the vapor source through a heated condensate return conduit, whereby the condensate is recycled to the vapor state;

carrying a first portion of the cooled gas that has passed through the heat exchanger through a cooled gas transfer conduit to a receiver accumulator, whereby the gas is stored;

carrying a second portion of the cooled gas that has passed through the heat exchanger through the cooled gas transfer conduit to the vapor condenser;

transferring heat from the exhaust formed in the vapor expander to the cooled gas in the vapor condenser, thereby reheating the gas;

carrying the re-heated gas through a re-heated gas conduit, to the gas expander;

expanding the re-heated gas in the gas expander to produce energy for driving a gas expander load;

urging, with the generated energy from the gas expander, articulation of a gas expander load, whereby electricity is generated; and carrying at least a portion of the re-heated gas from the gas expander to the compressor for further compression and heating of the gas, through a gas expander exhaust conduit.

2. The method of claim 1, wherein the step of compressing a gas with the compressor, whereby the compression of the gas raises the temperature of the gas, further comprises, whereby the compression of the gas raises the temperature of the gas by a factor directly proportional to the compression ratio of the compressor.

3. The method of claim 1, wherein the vapor source includes at least one of the following: a boiler, a heat exchanger, a source of stored heated liquid, a solar thermal collector, and a geothermal source of steam or hot water.

4. The method of claim 1, wherein the vapor expander includes at least one of the following: a turbine, a motor, a steam engine, and a thermal energy recovery system.

5. The method of claim 1, wherein the gas expander includes at least one of the following: a motor, a turbine, and an energy recovery device.

6. The method of claim 1, wherein the primary load includes at least one of the following: an electrical generation system, a pump, and a direct-connected mechanical device.

7. The method of claim 1, wherein the gas expander load includes at least one of the following: an electrical generation system, a pump, and a direct-connected mechanical device.

8. A system for harnessing latent heat to generate energy, the system comprising:

a vapor source generating a vapor;

a vapor expander receiving the vapor through a vapor source conduit, the vapor expander generating energy and exhaust a primary load receiving the energy from the vapor expander, and the primary load generating electricity as a result a vapor condenser receiving the exhaust from the vapor expander through a vapor expander exhaust conduit, the vapor condenser condensing the exhaust to form a condensate;

a compressor compressing a gas from a gas expander with the energy generated by the vapor expander, whereby the compression of the gas raises the temperature of the gas by a factor directly proportional to the compression ratio of the compressor;

a heat exchanger receiving the compressed and the heated gas through a hot gas transfer conduit to a heat exchanger, whereby the compressed and heated gas releases heat and consequently cools to a cooled gas while passing through the heat exchanger, whereby the heat released by cooling the gas heats the condensate to form the vapor in the vapor source;

a receiver accumulator receiving a first portion of the cooled gas that has passed through the heat exchanger through a cooled gas transfer conduit, whereby the gas is stored;

transferring heat from the exhaust formed in the vapor expander to the cooled gas in the vapor condenser to reheat the gas; and the gas expander receiving the re-heated gas through a re-heated gas conduit, the gas expander expanding the re-heated gas to produce energy for driving a gas expander load, whereby the gas is heated from the exhaust formed in the vapor expander.

9. The system of claim 8, wherein the vapor source includes at least one of the following: a boiler, a heat exchanger, a source of stored heated liquid, a solar thermal collector, and a geothermal source of steam or hot water.

10. The system of claim 8, wherein the vapor expander includes at least one of the following: a turbine, a motor, a steam engine, and a thermal energy recovery system.

11. The system of claim 8, wherein the gas expander includes at least one of the following: a motor, and a turbine.

12. The system of claim 8, wherein the primary load includes at least one of the following: an electrical generation system, a pump, and a direct-connected mechanical device.

13. The system of claim 8, wherein the gas expander load includes at least one of the following: an electrical generation system, a pump, and a direct-connected mechanical device.

* * * * *